US005227586A

United States Patent [19]

Beauchamp

[11] Patent Number: 5,227,586

[45] Date of Patent: Jul. 13, 1993

[54] FLAME RESISTANT ELECTRIC CABLE

[75] Inventor: Mark Beauchamp, St-Hubert, Canada

[73] Assignee: Harbour Industries, (Canada) Ltd., Farnham, Canada

[21] Appl. No.: 772,208

[22] Filed: Oct. 7, 1991

[51] Int. Cl.[5] ..... H01B 7/34

[52] U.S. Cl. ..... 174/122 R; 174/102 R; 174/107; 174/121 A; 174/121 AR; 174/122 G

[58] Field of Search ..... 174/122 R, 122 G, 121 A, 174/121 R, 121 AR, 110 S, 110 A, 110 AR, 102 R, 107

[56] References Cited

U.S. PATENT DOCUMENTS

| | | | |
|---|---|---|---|
| 3,192,309 | 6/1965 | Zoder et al. | 174/121 R |
| 3,303,270 | 2/1967 | Shelton, Jr. | 174/122 G |
| 3,576,388 | 4/1971 | Bruns | 174/121 A |
| 3,576,940 | 5/1971 | Stone et al. | 174/121 A |
| 3,823,255 | 7/1974 | LaGase et al. | 174/121 A |
| 3,828,119 | 8/1974 | Warburton et al. | 174/121 A |
| 5,008,495 | 4/1991 | Mudgett | 174/121 R |
| 5,075,514 | 12/1991 | Hurd | 174/121 A X |

FOREIGN PATENT DOCUMENTS

| | | | |
|---|---|---|---|
| 2381377 | 10/1978 | France | 174/121 A |
| 50517 | 4/1980 | Japan | 174/121 A |
| 8603329 | 6/1986 | PCT Int'l Appl. | 174/121 A |
| 2170646 | 8/1986 | United Kingdom | 174/121 A |

*Primary Examiner*—Morris H. Nimmo
*Attorney, Agent, or Firm*—Longacre & White

[57] ABSTRACT

The disclosure herein describes a flame resistant electric cable which is capable of resisting flame temperatures in the neighborhood of 1000° C. for at least two hours; the cable comprises an electrical conductor including an electrical wire, an extruded elongate tubular member made of silicone surrounding the electrical wire, and an outer protective layer of braided inorganic material which surrounds the tubular member; an overall outer braided jacket surrounds the electrical conductor.

5 Claims, 1 Drawing Sheet

FLAME RESISTANT ELECTRIC CABLE

FIELD OF THE INVENTION

The present invention relates to an electric cable which is capable of resisting flame temperatures.

BACKGROUND OF THE INVENTION

Electric cables which are capable of operating during a fire are more and more required in order to limit fire propagation in buildings Government regulations in various countries now specify that essential electrical circuits be protected in order to ensure that the electrical system be capable of operating to ensure the safety of persons inside the building and also to permit the firemen to be more efficient in controlling and extinguishing fires.

In certain locations, such as high buildings, a minimum amount of time is needed so that all persons may be reached. Therefore, the electrical system during a fire must be able to be maintained at least during that amount of time.

It has been established that some essential electrical circuits must be able to operate for at least two hours or in other case four hours in order to ensure the safety of people. Such systems include, for example, alarms which are, in turn, essential in order to enable other systems to be operated, such as telephone systems, lighting systems, elevator systems, ventilation systems, fire pumps, etc.

Many cables which are presently in use, are capable of resisting temperatures in the neighborhood of 1000° C. However, their resistance is limited to a period of 30 minutes. One cable which is presently used and known under the trademark Pyrotenax, is formed of a copper tube with a silica powder capable of resisting to higher temperatures. However, the rigid copper tube prevents the cable from being easily flexed thereby rendering it difficult to install in various sharp bends or corners, or the like.

OBJECTS AND STATEMENT OF THE INVENTION

An object of the present invention is to provide a flame resistant electric cable which is capable of resisting flame temperatures in the neighborhood of 1000° C. for at least two hours, thus overcoming the problems of the cables described above.

A further object of the present invention is to provide a flame resistant electrical cable, capable of resisting flame temperatures during a period of time while being flexible for easy installation.

This is achieved by providing a flame resisting electric cable which comprises: at least one electrical conductor having an electrical wire, an extruded elongate tubular member made of a silicone elastomer surrounding the electrical wire, and an outer protective layer of braided inorganic material surrounding the tubular member; and an overall outer braided jacket surrounding the electrical conductor In one preferred form of the invention, the inorganic material is silica.

In an other embodiment of the invention the inorganic material is ceramic.

Other objects and further scope of applicability of the present invention will become apparent from the detailed description given hereinafter. It should be understood, however, that this detailed description, while indicating preferred embodiments of the invention, is given by way of illustration only, since various changes and modifications within the spirit and scope of the invention will become apparent to those skilled in the art.

DESCRIPTION OF PREFERRED EMBODIMENT

Figure 1:
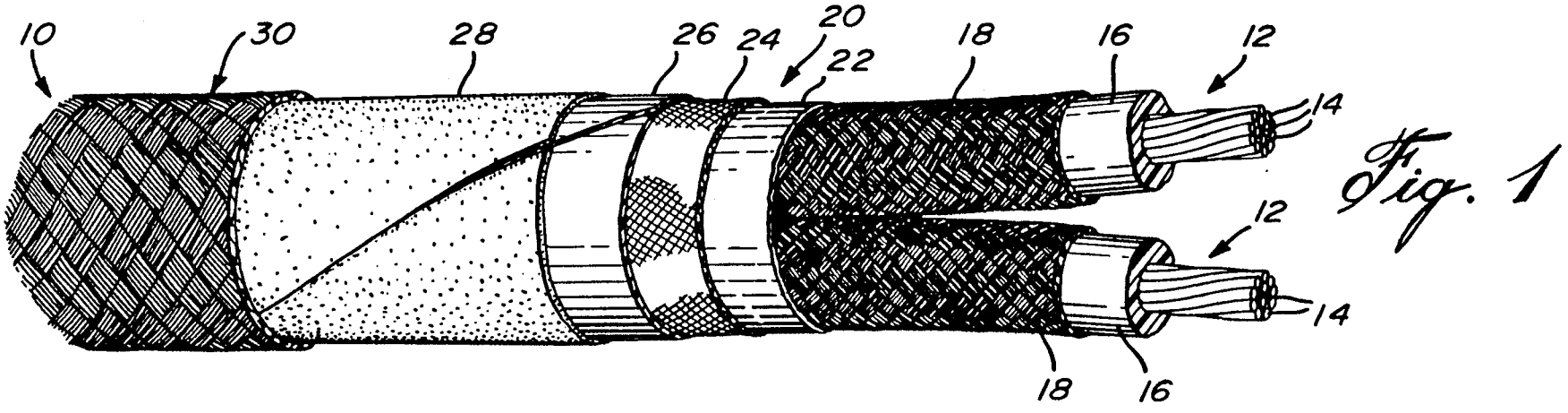
FIG. 1 is a fragmented perspective view of an electrical cable made in accordance with the present invention.

In the embodiment illustrated in FIG. 1, there is shown an electrical cable, generally denoted 10, having a pair of identically constructed conductors 12. Forming each conductor is a plurality of electrical conducting wires 14 which are tightly held in a tubular member 16 which is formed of a heat insulation material, preferably silicone rubber. The tubular member 16 is helically wrapped with an outer layer of braided inorganic material 18; this inorganic material is either silica or ceramic. The two electrical conductors 12 are received within a tubular member 20 which is formed of two helically wrapped layers 22 and 24 of a heat barrier material, such as mica. Surrounding layer 20 is a double helically wrapped layer 26 and 28 of ceramic material providing a humidity barrier. An overall outer braided jacket 30, preferably of fiberglass material, surrounds the double layer of ceramic material and provides a mechanical protection to the cable.

Figure 2:
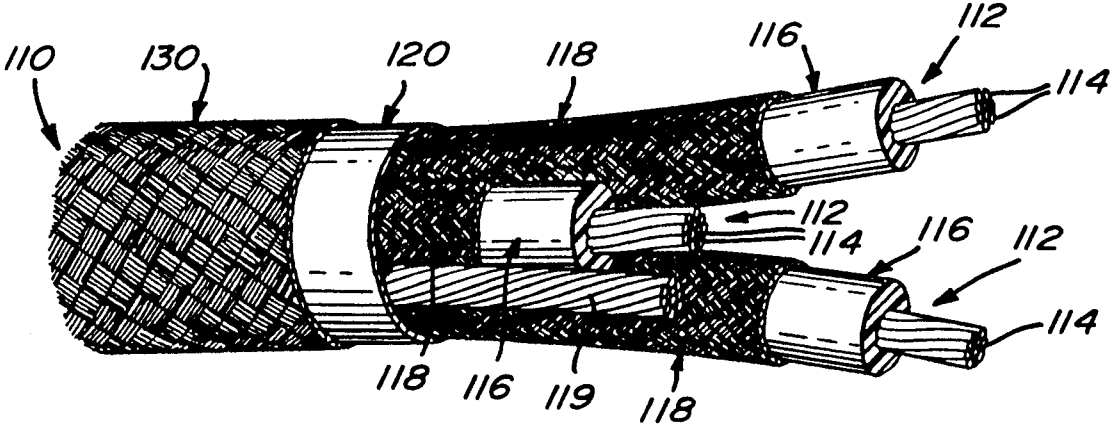
FIG. 2 is a fragmented perspective view of an other embodiment of an electrical cable made in accordance with the present invention.

In the embodiment illustrated in FIG. 2, there is shown a cable 110 which is formed of three identically constructed conductors 112 having components 114, 116 and 118, identical to that of the conductors 12 in FIG. 1. The three conductors together with a ground wire 119 are enclosed within a tubular member 120, which may be a thin aluminum Mylar® (polyethylene teraphtalate) shield which, in turn, is surrounded by an outer braided jacket 130 of fiberglass material The shield 120 provides a electrical barrier to the cable while the jacket 130 provides a mechanical protection thereto.

The combination of the various materials forming the components shown in FIGS. 1 and 2 provide the flexibility required to facilitate cable installation or transport.

Although the invention has been described above in relation to two specific forms, it will be evident to the person skilled in the art that it may be refined and modified in various ways. For example, although the drawings show cables having two and three electrical conductors, cables having more or less conductors may also be used. It is therefore wished to have it understood that the present invention should not be limited in interpretation except by the terms of the following claims.

The embodiments of the invention in which an exclusive property or privilege is claimed are defined as follows:

1. A flame resistant electric cable capable of resisting flame temperatures in the neighborhood of 1000° C. for at least two hours comprising: at least one electrical conductor consisting of an electrical wire, and extruded elongate tubular member made of silicone elastomer surrounding said electrical wire, an outer protective layer of braided inorganic material surrounding said tubular member, an aluminum polyethylene teraphtalate shield surrounding said layer of braided inorganic material, and an overall outer braided jacket surrounding said at least one electrical conductor.

2. A flame resistant electric cable as defined in claim 1 or 4 wherein said inorganic material is silica.

3. A flame resistant electric cable as defined in claim 1 or 4, wherein said inorganic material is ceramic.

4. A flame resistant electric cable capable of resisting flame temperatures in the neighborhood of 1000° C. for at least two hours comprising: at least one electrical conductor consisting of an electrical wire, and extruded elongated tubular member made of silicone elastomer surrounding said electrical wire, an outer protective layer of braided inorganic material surrounding said tubular member, a double layer of mica surrounding said layer of braided inorganic material, and an overall outer braided jacket surrounding said at least one electrical conductor.

5. A flame resistant electric cable as defined in claim 4 further comprising a double layer of ceramic material between said jacket and said double layer of mica.

* * * * *